US009889371B1

(12) United States Patent
Knust et al.

(10) Patent No.: US 9,889,371 B1
(45) **Date of Patent: *Feb. 13, 2018**

(54) BET SPOT INDICATOR ON A GAMING TABLE

(71) Applicant: Genesis Gaming Solutions, Inc., Spring, TX (US)

(72) Inventors: Randy L. Knust, The Woodlands, TX (US); Eric Schoppe, Conroe, TX (US)

(73) Assignee: Genesis Gaming Solutions, Inc., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/353,443

(22) Filed: Nov. 16, 2016

Related U.S. Application Data

(63) Continuation of application No. 14/855,777, filed on Sep. 16, 2015, now Pat. No. 9,511,275, which is a (Continued)

(51) Int. Cl.
*G08B 21/10* (2006.01)
*A63F 3/00* (2006.01)

(52) U.S. Cl.
CPC *A63F 3/00157* (2013.01); *A63F 2003/00164* (2013.01)

(58) Field of Classification Search
CPC .. G07F 17/3232; G07F 17/32; G07F 17/3241; G07F 17/3223; G07F 17/3276; G07F 17/3218; G07F 17/322; G07F 17/3239; G07F 17/3244; G07F 17/34; G07F 17/3293; G07F 17/3237; G07F 17/3279; G07F 17/328
(Continued)

(56) References Cited

U.S. PATENT DOCUMENTS 4,378,114 A 3/1983 Sargent
4,531,187 A 7/1985 Uhland
(Continued)

OTHER PUBLICATIONS

U.S. Appl. No. 14/498,281, Knust et al.
(Continued)

*Primary Examiner* — Daniel Previl
(74) *Attorney, Agent, or Firm* — Winstead PC

(57) ABSTRACT

The invention generally pertains to a system and method for determining if a player has placed a bet in a bet spot on a gaming table, such as, for example, a main bet spot or a progressive or proposition bet spot. By way of example, the tabletop of a gaming table has a plurality of player positions having one or more bet spots positioned in proximity to each player position on the top surface. The tabletop has a light sensor associated with each bet spot and positioned beneath the gaming table layout to detect light intensity through the layout. A plurality of light emitting diodes (LEDs) are associated with each light sensor. The plurality of LEDs are located beneath the gaming table layout so as to illuminate through the material of the gaming table layout. More specifically, the LEDs are configured to illuminate through the layout when a gaming chip is detected in the bet spot, which causes a change in the light intensity detected by the light sensor associated with the bet spot because the bet spot is covered by a gaming chip.

20 Claims, 12 Drawing Sheets

Related U.S. Application Data continuation of application No. 13/842,416, filed on Mar. 15, 2013, now Pat. No. 9,165,420, which is a continuation-in-part of application No. 13/297,081, filed on Nov. 15, 2011, now Pat. No. 8,896,444, and a continuation-in-part of application No. 12/270,476, filed on Nov. 13, 2008, now Pat. No. 8,130,097.

(60) Provisional application No. 61/413,633, filed on Nov. 15, 2010, provisional application No. 60/987,570, filed on Nov. 13, 2007.

(58) Field of Classification Search
USPC ..... 340/540, 541, 556, 562, 573.1, 573.7, 340/542, 568.8, 572.1–572.9, 815.45, 642
See application file for complete search history.

(56) References Cited

U.S. PATENT DOCUMENTS 5,451,054 A 9/1995 Orenstein
5,649,705 A 7/1997 String
5,653,640 A 8/1997 Shirley, Jr.
5,781,647 A 7/1998 Fishbine et al.
5,831,527 A 11/1998 Jones, II et al.
5,919,090 A 7/1999 Mothwurf
5,957,776 A 9/1999 Hoehne
6,059,659 A 5/2000 Busch et al.
6,154,131 A 11/2000 Jones, II et al.
6,267,671 B1 * 7/2001 Hogan ..... A63F 3/00157 463/25
6,313,871 B1 * 11/2001 Schubert ..... H04N 7/183 348/143
6,446,864 B1 9/2002 Kim et al.
6,460,848 B1 * 10/2002 Soltys ..... G06Q 10/0639 273/149 R
6,567,159 B1 5/2003 Corech
6,848,994 B1 * 2/2005 Knust ..... G06Q 20/04 273/148 R
7,431,650 B2 10/2008 Kessman et al.
7,690,996 B2 4/2010 Iddings et al.
7,878,909 B2 2/2011 Kessman et al.
8,092,293 B2 1/2012 Richards et al.
8,100,753 B2 1/2012 Soltys
8,130,097 B2 3/2012 Knust et al.
8,480,091 B1 7/2013 Florence
8,528,909 B2 9/2013 Gelinotte et al.
8,636,575 B2 1/2014 Lutnick et al.
8,783,688 B2 7/2014 Gelinotte et al.
8,896,444 B1 11/2014 Knust et al.
9,165,420 B1 * 10/2015 Knust ..... G07F 17/3211
9,174,114 B1 * 11/2015 Knust ..... A63F 1/067
9,511,275 B1 * 12/2016 Knust ..... G07F 17/3211
2001/0010025 A1 7/2001 Knust et al.
2002/0072405 A1 6/2002 Soltys et al.
2002/0111213 A1 8/2002 McEntee et al.
2002/0123376 A1 9/2002 Walker et al.
2003/0003997 A1 1/2003 Vuong et al.
2003/0171143 A1 9/2003 Valdez et al.
2004/0029629 A1 2/2004 Bourbour et al.
2004/0172772 A1 9/2004 Santiago
2004/0182772 A1 9/2004 Dannenmaier et al.
2005/0026684 A1 2/2005 Sumi et al.
2005/0090310 A1 4/2005 Knust et al.
2005/0093241 A1 * 5/2005 Lipscomb ..... A47B 25/00 273/309
2005/0236771 A1 10/2005 Soltys et al.
2005/0277463 A1 12/2005 Knust et al.
2005/0288083 A1 12/2005 Downs
2005/0288084 A1 12/2005 Schubert
2005/0288086 A1 12/2005 Schubert et al.
2006/0128455 A1 6/2006 Bourbour et al.
2006/0177109 A1 8/2006 Storch
2006/0183540 A1 8/2006 Grauzer et al.
2006/0252521 A1 11/2006 Gururajan et al.
2006/0252554 A1 11/2006 Gururajan et al.
2007/0045958 A1 3/2007 Rader et al.
2007/0057469 A1 3/2007 Grauzer et al.
2007/0077987 A1 4/2007 Gururajan et al.
2007/0080496 A1 4/2007 Feola
2007/0117604 A1 5/2007 Hill
2007/0296151 A1 12/2007 Kyrychenko
2008/0113767 A1 5/2008 Nguyen et al.
2008/0113772 A1 5/2008 Burrill et al.
2008/0136108 A1 6/2008 Polay
2008/0150234 A1 6/2008 Makieil
2009/0131151 A1 5/2009 Harris et al.
2009/0191933 A1 7/2009 French
2009/0253498 A1 10/2009 Wolf et al.
2011/0204565 A1 8/2011 Gelinotte et al.
2012/0208622 A1 8/2012 Delaney et al.

OTHER PUBLICATIONS

U.S. Appl. No. 14/215,392, Knust et al.
U.S. Appl. No. 14/043,692, Knust et al.
U.S. Appl. No. 13/842,126, Knust et al.
U.S. Appl. No. 13/842,416, Knust et al.
U.S. Appl. No. 14/855,777, Knust et al.
Parets, Robyn Taylor, "The newer Deal", International Gaming & Wagering Business, Apr. 1997, 2 pages.
Stimpson, Jennifer, "How to Build a Poker Table," This Old House, retrieved from Internet on May 31, 2015 and published Mar. 25, 2011 from <http://web.archive.org/web/20110325082217/http://www.thisoldhouse.com/toh/how-to/step/0%2c%2c20474800_20926199%2c00.html#>, p. 9.

* cited by examiner

BET SPOT INDICATOR ON A GAMING TABLE

CROSS-REFERENCE TO RELATED APPLICATIONS

This patent application is a continuation of U.S. patent application Ser. No. 14/855,777 filed on Sep. 16, 2015. U.S. patent application Ser. No. 14/855,777 is a continuation of U.S. patent application Ser. No. 13/842,416 filed on Mar. 15, 2013. U.S. patent application Ser. No. 13/842,416 is a continuation-in-part of U.S. patent application Ser. No. 13/297,081 filed on Nov. 15, 2011. U.S. patent application Ser. No. 13/297,081 is a continuation-in-part of U.S. patent application Ser. No. 12/270,476 filed on Nov. 13, 2008 and claims priority from U.S. Provisional Application No. 61/413,633 filed on Nov. 15, 2010. U.S. patent application Ser. No. 12/270,476 claims priority from U.S. Provisional Application No. 60/987,570 filed on Nov. 13, 2007. U.S. patent application Ser. Nos. 14/855,777, 13/842,416, 13/297,081 and 12/270,476 and U.S. Provisional Application Nos. 61/413,633 and 60/987,570 are incorporated by reference herein in their entirety.

TECHNICAL FIELD

The present invention relates generally to the field of gaming systems, and, more particularly, but not by way of limitation, to a system and method for determining if a player has placed a bet in a bet spot on a gaming table, such as, for example, a main bet spot or a progressive or proposition bet spot.

BRIEF SUMMARY

In one embodiment, a gaming table is illustrated and described comprising a tabletop having a top surface covered by a gaming table layout. The tabletop has a plurality of player positions, each player position having an associated bet spot positioned in proximity to each player position on the top surface. The tabletop further has a light sensor associated with each bet spot and positioned beneath the gaming table layout to detect light intensity through the layout. A plurality of light emitting diodes (LEDs) are positioned in proximity to and associated with each light sensor. The plurality of LEDs are located beneath the gaming table layout so as to illuminate through the material of the gaming table layout. More specifically, the LEDs are configured to illuminate through the layout when a gaming chip is detected in the bet spot, which causes a change in the light intensity detected by the light sensor associated with the bet spot because the bet spot is covered by the gaming chip.

In another embodiment, the gaming table further comprising a means for determining the value of the gaming chip in the bet spot, such as an antenna associated with the bet spot and an RFID reader coupled to the antenna or a camera.

In another embodiment, the bet spot is a progressive bet spot and the gaming table further comprises a dealer unit communicatively coupled to the light sensors and a progressive display positioned proximate the gaming table. The dealer unit is configured to transmit notifications to automatically lock and store information regarding a progressive bet placed in the progressive bet spot when the dealer unit is activated. The progressive display is operable to display a progressive jackpot value.

In yet another embodiment, a gaming system is illustrated and described comprising a plurality of gaming tables and a central computer communicably coupled to each gaming table. Each gaming table comprises a tabletop having a top surface covered by a gaming table layout and a plurality of player positions. Each player position has a progressive bet spot associated with each player position and is positioned in proximity to each player position on the top surface. A light sensor is associated with each progressive bet spot and is positioned beneath the gaming table layout to detect light intensity through the layout. A plurality of light emitting diodes (LEDs) are associated with each light sensor. The plurality of LEDs are positioned beneath the gaming table layout in proximity to the associated light sensor to illuminate through the material of the layout. The LEDs are configured to illuminate when a gaming chip is detected in the progressive bet spot, which causes a change in the light intensity detected by the light sensor associated with the covered progressive bet spot.

The gaming table also has a dealer unit communicatively coupled to the light sensors. The dealer unit is configured to transmit notifications to automatically lock and store information regarding a progressive bet placed in the progressive bet spots when the dealer unit is activated. The gaming table further comprises a progressive display positioned proximate the gaming table operable to display a progressive jackpot value. In the illustrated embodiment, the gaming table further comprises an electronic system communicably coupled to the dealer unit, the at least one light sensor and the plurality of LEDs. The electronic system is operable to detect changes in light intensity at the at least one light sensor and thereafter illuminate the plurality of LEDs associated with the light sensor having a change in the light intensity. The central computer of the system is operable to perform at least one operation based on a status of the at least one light sensor.

In yet another embodiment, the system further comprises a keypad communicably coupled to the central computer. The keypad is positioned on the tabletop in proximity to a dealer position at the gaming table. The keypad is operable to receive a dealer command and transmit dealer command to the central computer, for example a dealer command to automatically lock and stores a progressive bet placed in the progressive bet spots when the dealer command is activated.

In still another embodiment, a method of indicating the presence of a player bet in a bet spot (e.g., a progressive bet spot or a proposition bet spot) is illustrated and described. Typically, a change in light intensity in proximity to a player position at a gaming table is detected. In the illustrated embodiment, the detection is typically performed via a light sensor positioned beneath a gaming table layout on the gaming table and comprises detecting the change in light intensity through the layout. At a central computer, at least one operation is performed based on a status of the at least one light sensor. A plurality of light emitting diodes (LEDs) are illuminated in response to detecting a change in the light intensity at the light sensor. In the illustrated embodiment, the illumination is performed via a plurality of LEDs associated with the light sensor and positioned beneath the gaming table layout on the gaming table. The step of illuminating comprises activating the LEDs associated with the light sensor that detected the change in light intensity.

In yet another embodiment, a system is illustrated and described comprising at least one gaming table and a central computer. The gaming table has a tabletop with a top surface covered by a gaming table layout and a plurality of player positions. A bet spot is associated with each player position and is positioned in proximity to each player position on the top surface. At least one light sensor is positioned beneath the gaming table layout to detect light intensity at the bet spot through the layout. A plurality of light emitting diodes (LEDs) is associated with each light sensor. The plurality of LEDs are positioned beneath the gaming table layout to illuminate through the layout in response to changes in light intensity at the light sensor associated with the bet spot, such as, for example, when a gaming chip covers the bet spot. The gaming table is also provided with an electronic system communicably coupled to each light sensor and the associated plurality of LEDs. The electronic system is operable to detect changes in light intensity at the light sensor and thereafter illuminate the plurality of LEDs associated with any light sensor having a change in light intensity. The central computer is operable to perform at least one operation based on a status of the at least one light sensor.

The foregoing and other features, utilities and advantages of the invention will be apparent from the following more particular description of various embodiments of the invention as illustrated in the accompanying drawings and claims.

BRIEF DESCRIPTION OF THE DRAWINGS

A more complete understanding of the method and apparatus of the present invention may be obtained by reference to the following Brief Description when taken in conjunction with the accompanying Drawings wherein.

BRIEF DESCRIPTION

In the following description, numerous specific details are set forth, such as examples of specific shapes, components etc., in order to provide a thorough understanding of the present invention. It will be apparent, however, to one skilled in the art that the present invention may be practiced without these specific details. In other instances, well known components or methods have not been described in detail, but rather in general terms in order to avoid unnecessarily obscuring the present invention. Thus, the specific details set forth are merely exemplary. The specific details may be varied from and still be contemplated to be within the spirit and scope of the present invention.

Reference to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices. It is further contemplated within the scope of this invention that calculations can also be done mentally, manually or using processes other than electronic.

Figure 1:
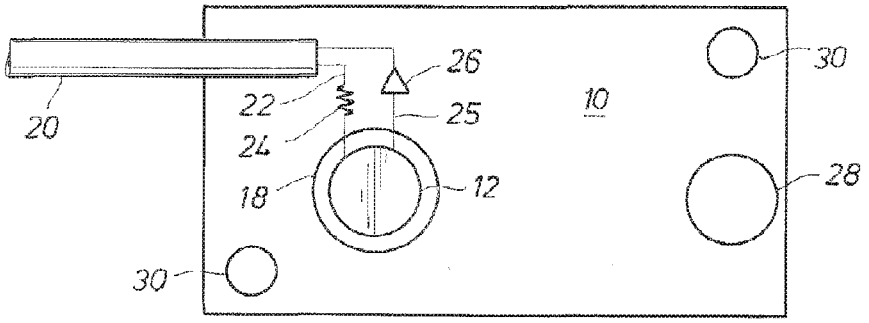
FIG. 1 is a plan schematic diagram of a chip or card detection system.

FIG. 1 illustrates a charge coupled device (CCD) light sensor board 10, in accordance with the teachings of the present invention. One such light sensor board 10 is associated with each player position around a gaming table, as shown and described below in greater detail. The CCD light sensor board 10 generally comprises a cadmium sulphide sensor 12 whose resistance changes in response to light, as powered from a cable 20 through a conductor 22. The light sensor 12 pulls against a resistance 24 to create a changing voltage point, in a manner known in the art. This changing voltage point is measured using an Analog to Digital (A/D) converter 26 through a conductor 25 and calibrated continuously to detect changes in light through fabrics and changing lighting conditions. The light sensor board 10 also contains a light-emitting diode 28 which serves as a location indicator and is optically isolated from the light sensor. The entire light sensor board assembly is preferably mounted to a gaming table beneath the table-covering felt with a set of mounting holes 30.

Figure 2:
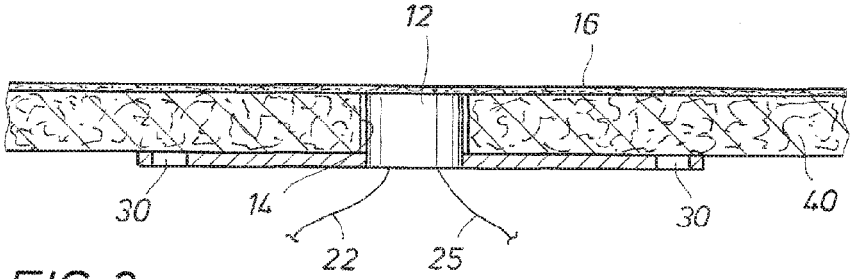
FIG. 2 is a side section view through a table top illustrating the light sensor sensing change in light energy transmitted through a table top felt on a gaming table.

As shown in FIGS. 1 and 2, a tabletop 40 includes a light sensor 12 mounted in a hole 14 in the tabletop. The light sensor 12 is mounted in such a way that it is substantially flush with the top surface of the tabletop. A felt layer 16 is installed over the tabletop over the light sensor. The light sensor senses changes in light entering the light sensor through the felt. When a new felt is installed, a registration pattern 18 FIG. 1), which is printed on the felt, is installed over the light sensor. So, when a chip or a card is placed over the sensor, or even if it just passes over the sensor, the sensor detects the change in ambient light and informs the data collection system.

Figure 3:
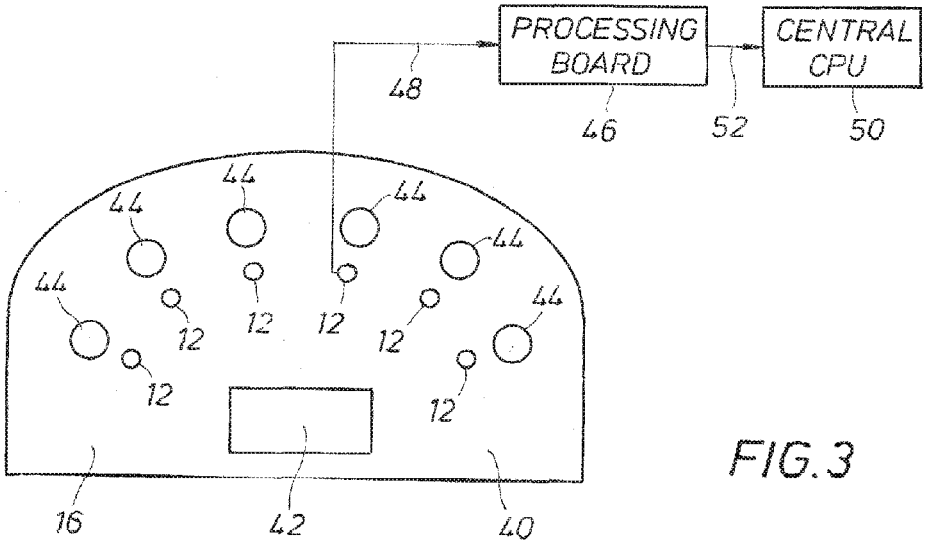
FIG. 3 is a schematic view of a data transmission portion of the system.

FIG. 3 illustrates one preferred embodiment of a reporting system using the card and chip detection system of FIGS. 1 and 2. The tabletop 40 is covered with a felt layer 16, as previously described. A dealer's position 42 is positioned along one location beside the gaming table, while a plurality of player positions 44 are arrayed in a semi-circle along the side of the table. A sensor 12 is positioned adjacent each player position.

Each of the sensors 12 is coupled electronically with a processing board 46 through a connection 48. The processing board 46 is electronically coupled to a central processing unit (CPU) 50, possibly wirelessly, through a connection 52. In various embodiments, the connection 52 includes a transceiver assigned to the table that receives data from the processing board 52 and transmits the data to the CPU 50. The transceiver may be, for example, a computing device that communicates via wired Ethernet or wirelessly. In a typical embodiment, the CPU 50 is representative of a management system such as, for example, a casino management system, and may be representative of one or more physical or virtual server computers. In a typical embodiment, the CPU 50 stores for and facilitates management of a plurality of gaming tables.

Preferably, each of the sensors 12 is monitored continuously, so that any alteration in the state of the A/D converter 26 (FIG. 1) associated with any sensor will be sensed by the processing board 46 and transmitted to the CPU and stored. This allows the proprietor to maintain an up to the minute determination of the gaming at each player position throughout the establishment, such as for example in a casino.

Figure 4:
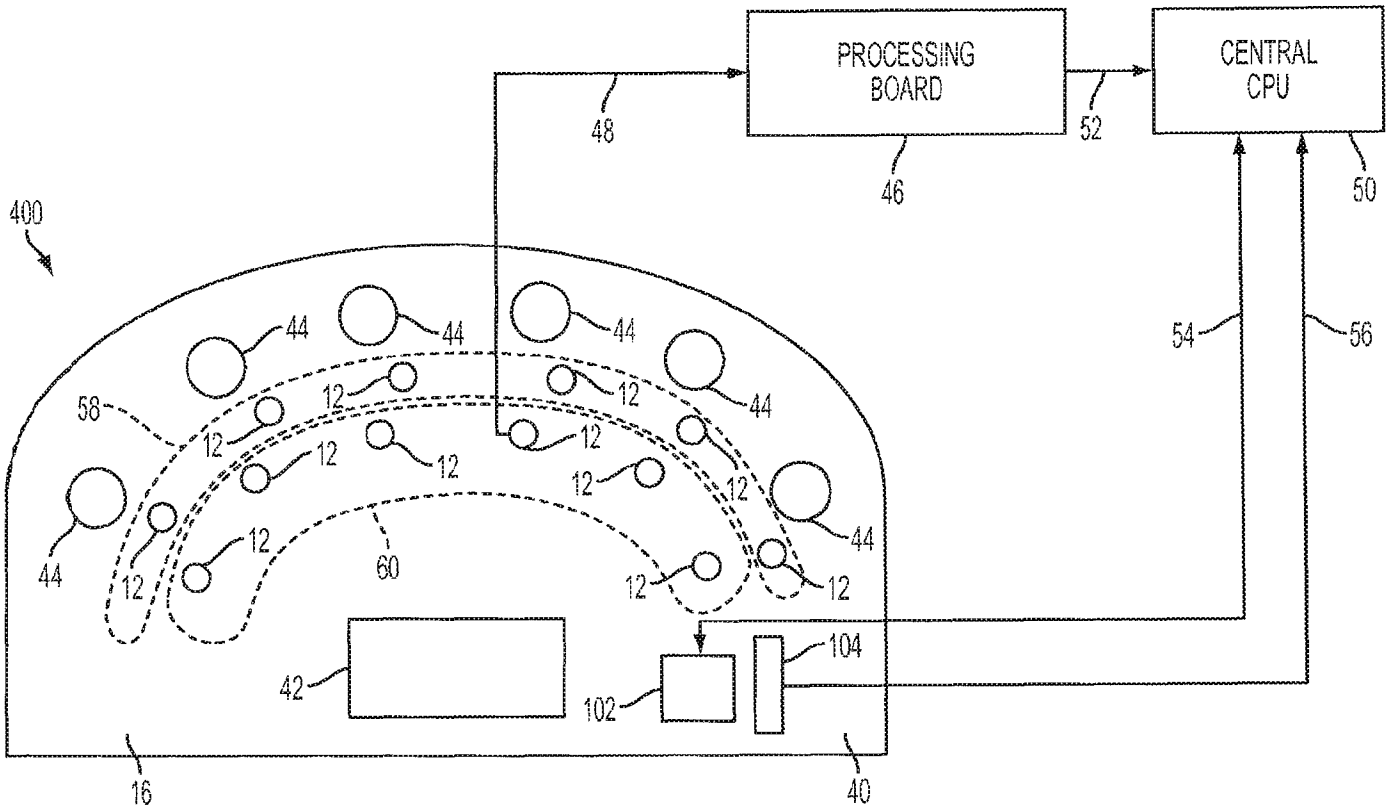
FIG. 4 is a schematic view of a data transmission portion of the system.

FIG. 4 illustrates another embodiment of a reporting system using the card and chip detection system of FIGS. 1 and 2. In particular, a gaming table 400 is illustrated. For purposes of simplicity, the sensors 12 illustrated with respect to FIG. 3 and described above are grouped together in FIG. 4 as a first group 60. A second group 58 of the sensors 12 is disposed above the first group 60 and adjacent to the player positions 44. A dealer keypad 102 and a card-reading apparatus 104 are positioned on the tabletop 40 in proximity to the dealer's position 42.

The dealer keypad 102 and the card-reading apparatus 104 are electronically coupled to the central processing unit (CPU) 50 through a connection 54 and a connection 56, respectively. In various embodiments, the connections 54 and 56 include a transceiver assigned to the table that receives and transmits data to the CPU 50. In the case of the connection 54, the transceiver may relay data intended for the dealer keypad 102 from the CPU 50 to the dealer keypad 102. The transceiver may be, for example, a computing device that communicates via wired Ethernet and/or wirelessly. In various embodiments, the connections 48, 54, and 56 may share a single transceiver.

The dealer keypad 102 and the card-reading apparatus 104 allow a dealer to practice more efficient management of players at the gaming table 400, for example, in a casino pit. Operation of the dealer keypad 102 and the card-reading apparatus 104 will be described in greater detail with respect to FIGS. 5-8.

In a typical embodiment, the sensors 12 in the second group 58 facilitate additional bets such as proposition bets (i.e. side bets). One of ordinary skill in the art will appreciate that a proposition bet refers to a bet made regarding the occurrence or non-occurrence during a game of an event not directly affecting the game's outcome. For example, during a game of blackjack, proposition bets could be established related to which cards will be dealt (e.g., a "Lucky Ladies" proposition bet that wins only if a player is dealt the queen of hearts and the dealer receives blackjack). Numerous types of proposition bets are possible and will be apparent to one of ordinary skill in the art.

In a typical embodiment, the sensors 12 in the second group 58 may be used to determine whether a proposition bet has been placed. If one or more gaming objects (e.g., chips) are placed over any of the sensors 12 in the second group 58, the alteration in the state of the A/D converter 26 (FIG. 1) associated therewith will be sensed by the processing board 46 and transmitted to the central CPU 50 and stored. In that way, the central CPU 50 stores each proposition bet and can track proposition bets and the frequency with which particular players make proposition bets. This allows the proprietor to maintain an up to the minute determination of proposition bets at each player position throughout the establishment such as, for example, in a casino.

Figure 5:
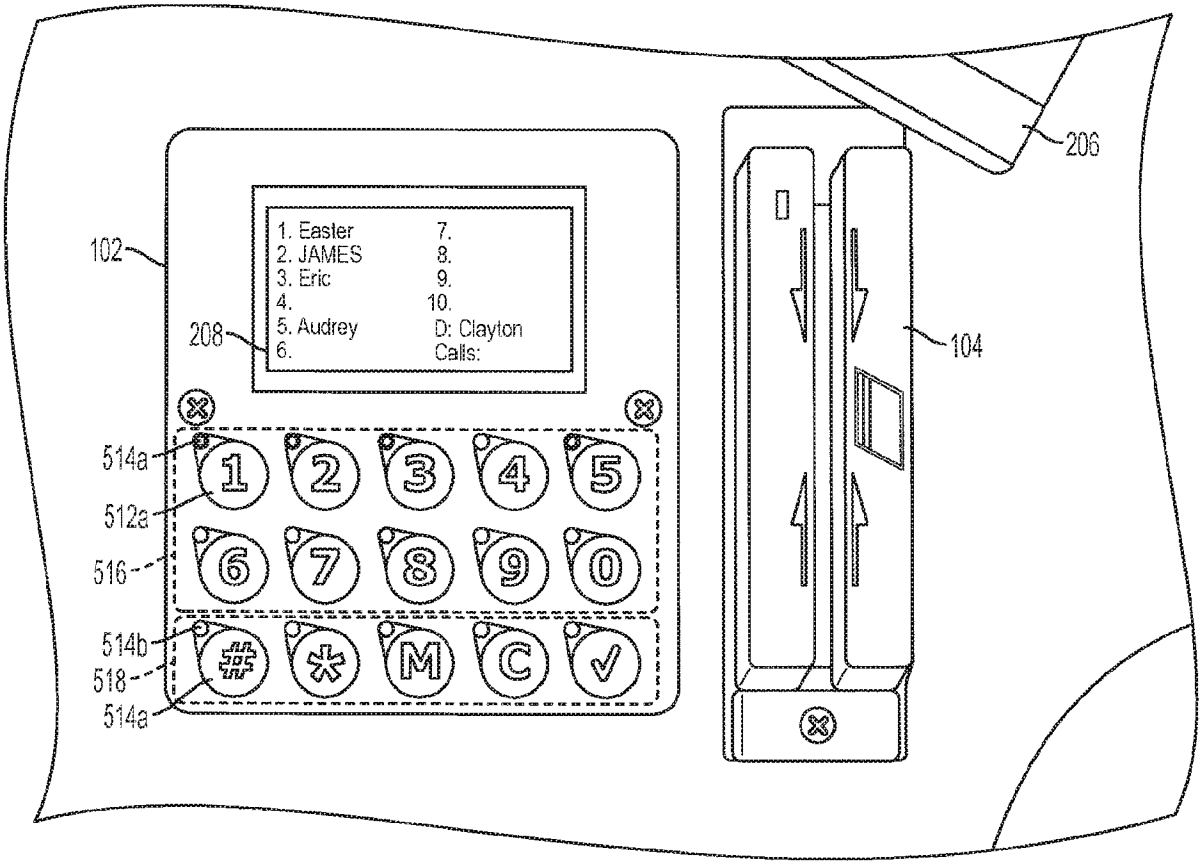
FIG. 5 illustrates a dealer keypad and a card-reading apparatus.

FIG. 5 illustrates the dealer keypad 102 and the card-reading apparatus 104 of FIG. 4 in greater detail. The dealer keypad 102 includes a display 208 that may be, for example, a liquid crystal display (LCD). The dealer keypad 102 additionally includes a numbered section 516 and a command section 518. The numbered section 516 includes a plurality of numbered buttons 512*a* and a plurality of indicator lights 514*a* that are each associated with one of the numbered buttons 512*a*. The command section 518 includes a plurality of command buttons 512*b* and a plurality of indicator lights 514*b* that are each associated with one of the command buttons 512*b*.

For simplicity of reference herein, individual buttons in the plurality of numbered buttons 512*a* or the plurality of command buttons 512*b* may be referred to by a label appearing thereon (e.g., "the numbered button 512*a* labeled '1'" or "the command button 512*b* labeled '#'"). Likewise, for simplicity of reference, individual indicator lights in the plurality of indicator lights 514*a* or the plurality of indicator lights 514*b* may be individually pointed out with reference to an associated button from the plurality of numbered buttons 512*a* or the plurality of command buttons 512*b*, respectively (e.g., "the indicator light 514*a* associated with the numbered button 512*a* labeled '1'" or "the indicator light 514*b* associated with the command button 512*b* labeled '#'"). Finally, for further simplicity, individual indicator lights from the plurality of indicator lights 514*a* or the plurality of indicator lights 514*b* may be individually pointed out solely with reference to a label appearing on a button with which it is associated (e.g., "the indicator light 514*a* associated with '1'" or "the indicator light 514*b* associated with '#'").

In general, numbers that appear on the plurality of numbered buttons 512*a* correspond to a player position such as, for example, one of the plurality of player positions 44. For example, with reference to FIG. 4, each of the plurality of player positions 44 can be assigned a position number from one to six (e.g., from left to right from the dealer's perspective). With reference to FIG. 5, the display 208 indicates, by way of example, that position numbers one, two, three, and five are occupied while position numbers four and six are vacant. In a typical embodiment, the dealer keypad 102 additionally represents table occupancy by causing indicator lights 514*a* associated with occupied player positions to be lit. For purposes of the example depicted in FIG. 5, the dealer keypad 102 lights the indicator lights 514*a* associated with the numbered buttons 512*a* labeled '1', '2', '3', and '5'.

Still referring to FIG. 5, the card-reading apparatus 104 is typically operable to accept, for example, a card having a magnetic stripe 206 disposed thereon. In a typical embodiment, the magnetic stripe 206 includes information that uniquely identifies, for example, a player. The information can be used to access biographical or historical data regarding the player. For example, in operation, the card may be oriented so that the magnetic stripe 206 faces left on the card-reading apparatus 104 and is swiped in a downward direction.

Exemplary functionality of the dealer keypad 102 will now be described. In various embodiments, the dealer keypad 102 facilitates dealer check-in functionality. Prior to a dealer being checked-in, operation of the dealer keypad 102 is typically locked. To check-in, the dealer swipes an employee card using the card-reading apparatus 104. With reference to FIG. 4, the card-reading apparatus 104 transmits identification information gleaned from the employee card to the CPU 50 via the connection 56. The central CPU 50 registers the dealer for the gaming table 400 and returns the registration to the dealer keypad 102 via the connection 54. At the dealer keypad 102, the indicator light 514*b* associated with the command button 512*b* labeled '✓' becomes lit. After the dealer presses the command button 512*b* labeled '✓', the associated indicator light 514*b* turns off and the dealer's name appears on the display 208. At that point, functionality is unlocked and the dealer is enabled to operate the dealer keypad and perform, for example, the functionality described below.

In various embodiments, the dealer keypad 102 facilitates player check-in functionality. In various embodiments, the dealer keypad 102 enables player check-in with or without a cash buy-in. Exemplary functionality for checking-in a player without a cash buy-in will be described first.

To check-in a player without a cash buy-in, the dealer swipes a player card using the card-reading apparatus 104. With reference to FIG. 4, the card-reading apparatus 104 transmits identification information gleaned from the player card to the CPU 50 via the connection 56. The CPU 50 subsequently indicates to the dealer keypad 102 that a player registration process is occurring and the dealer keypad 102 causes the indicator light 514*b* associated with the command button 512*b* labeled '✓' to become lit. At this point, the dealer presses the command button 512*b* labeled '✓' again and then presses the numbered button 512*a* labeled with a desired position number at the gaming table 400 (e.g., '1', '2', '3', etc.).

In some embodiments, a buy-in interface may appear on the display 208. In these embodiments, the dealer presses the command button 512*b* labeled '✓' again to exit the buy-in interface. The desired position number and the buy-in amount (i.e., zero) are transmitted to the CPU 50 via the connection 54. Then, the CPU 50 confirms the player registration and transmits a desired alias such as, for example, the player's first name, to the dealer keypad 102. At this point, the player's alias (received from the CPU 50) appears on the display 208 in connection with the desired position number at the gaming table 400. Also, the dealer keypad 102 causes the indicator light 514*a* associated with the desired position number to become lit.

Operation of the dealer keypad 102 to facilitate player check-in with a cash buy-in will now be described. Player check-in with a cash buy-in proceeds as described above with respect to player check-in without a cash buy-in except that the dealer does not immediately exit the buy-in interface. The buy-in interface on the display 208 allows the dealer to enter a buy-in amount as cash, chips, or marker. In a typical embodiment, the buy-in interface on the keypad 102 defaults to cash but can be toggled to chips or marker by pressing, for example, the command button 512*b* labeled '*'. In a typical embodiment, the dealer toggles between cash, chips, and marker as appropriate to select the appropriate type of buy-in.

To simplify buy-in entry, in some embodiments, the dealer keypad 102 may utilize a multiplier such as, for example, one-hundred, so that a $200 buy-in amount could be entered by pressing the numbered button 512*a* labeled '2'. In these embodiments, if the buy-in amount is not compatible the multiplier (e.g., the buy-in amount is not a multiple of one-hundred), the dealer can press, for example, the command button 512*b* labeled '#' and enter the exact amount via the numbered buttons 512*a*.

After the buy-in amount is entered, the dealer presses, for example, the command button 512*b* labeled '✓', to indicate completion. The desired position number and the buy-in amount are transmitted to the CPU 50 via the connection 54. Then, the CPU 50 confirms the player registration and transmits a desired alias such as, for example, the player's first name (received from the CPU 50), to the dealer keypad 102. At this point, the player's alias appears on the display 208 in connection with the desired position number. Also, the dealer keypad 102 causes the indicator light 514*a* associated with the desired position number to become lit.

In various embodiments, the keypad 102 additionally enables the dealer to check-in a player who does not have a player card as a guest. To check-in a player who does not have a player card, the dealer presses, for example, the command button 512*b* labeled '✓', which causes the associated indicator light 514*b* to become lit. The guest can be checked-in either with or without a buy-in as described above with respect to players with player cards. Subsequently, the keypad 102 notifies the CPU 50 of the guest's registration and transmits the guest's desired position number and any buy-in amount. Then, the CPU 50 confirms the guest registration and transmits an alias such as, for example, "guest," to the dealer keypad 102. At this point, the alias appears on the display 208 in connection with the guest's desired position number. Also, the indicator light 514*a* associated with the guest's desired position number becomes lit.

In various embodiments, the keypad 102 additionally enables the dealer to enter an average bet for players at the gaming table 400. In a typical embodiment, the average bet is utilized, for example, to calculate player ratings for purposes of determining comps. To enter an average bet, the dealer presses, for example, the command button 512*b* labeled '*' and presses the numbered button 512*a* that is labeled with the appropriate player position number. Subsequently, the dealer enters the average bet amount via the numbered buttons 512*a* and presses, for example, the command button 512*b* labeled '✓' to indicate completion. The entered average bet amount is transmitted to the CPU 50 via the connection 54.

In various embodiments, the dealer keypad 102 enables the dealer to perform player check-out functionality. In a typical embodiment, players (and guests) can be checked-out from the gaming table with or without a walk-with amount. If a player is being checked-out without a walk-with amount, the dealer can press, for example, the command button 512*b* labeled '✓' followed by the numbered button 512*a* labeled with the player's position number. Subsequently, the dealer keypad 102 notifies the CPU 50 and receives a confirmation from the CPU 50 that the player is checked-out. At that point, the indicator light 514*a* associated with the player's position number turns off and the player's name is removed from the display 208.

If the player is being checked-out with a walk-with amount, the dealer can press, for example, the command button 512*b* labeled '✓' followed by the numbered button 512*a* labeled with the player's position number. Subsequently, the dealer enters an amount that the player is leaving the table with (i.e., a walk-with amount) using appropriate buttons from the numbered buttons 512*a*. Once the walk-with amount is entered, the dealer presses, for example, the command button 512*b* labeled '✓', and the dealer keypad 102 notifies the CPU 50. Once the dealer keypad 102 receives confirmation from the CPU 50 that the player is checked-out, the indicator light 514*a* associated with the player's position number turns off and the player's name is removed from the display 208.

In various embodiments, the dealer keypad 102 enables the dealer to perform lobby functionality. For example, if a player gets up to take a break (i.e. lobbying), the dealer logs the player as temporarily away by pressing, for example, the numbered button 512*a* corresponding to the player's position number. In a typical embodiment, the indicator light 514*a* associated with the player's position number flashes to indicate that the player is lobbying. The player's status of lobbying is reported to the CPU 50. In this manner, the player's position at a gaming table is reserved but the player is not credited for time or hands when the player is not at the gaming table. In this manner, over-comping of players based on time not spent at the gaming table can be prevented. When the player returns, the dealer can again press the numbered button 512*a* corresponding to the player's position number and the indicator light 514*a* associated with the player's position number stops flashing.

In various embodiments, the dealer keypad 102 additionally enables the dealer to move players from one position number to another position number when, for example, a player desires to move to a different position at a gaming table. In various embodiments, the dealer can accomplish a move of the player via a three-button sequence. In particular, the dealer can press the command button 512*b* labeled 'M', the numbered button 512*a* corresponding to the player's current position number, and the numbered button 512*a* corresponding to the player's new position number. Then, the dealer keypad 102 notifies the CPU 50 of the move. Upon receipt of confirmation from the CPU 50, the dealer keypad 102 updates the display 208 to reflect the player's name at the new position number.

In various embodiments, the dealer keypad 102 also enables the dealer to more efficiently accommodate players that are playing at more than position number. Specifically, the dealer keypad 102 permits the dealer to copy a player's information from one position number to a second position number that will be occupied by the same player. In a typical embodiment, a copy can be accomplished via a three-button sequence. In particular, the dealer can press the command button 512*b* labeled 'C', the numbered button 512*a* corresponding to the player's current position number, and the numbered button 512*a* corresponding to the player's additional position number. At that point, the dealer keypad 102 notifies the CPU 50 of the copy. Upon receipt of confirmation from the CPU 50 that the copy has been accomplished, the dealer keypad 102 updates the display 208 to show the player's name at the additional position number.

In various embodiments, the dealer keypad 102 further enables the dealer to input additional cash buy-in for a player. To enter additional cash buy-in, the dealer can press, for example, the command button 512*b* labeled '#' followed by the numbered button 512*a* corresponding to the player's position number. Then, the dealer keypad provides a buy-in interface to the dealer. After receiving the additional buy-in amount in a manner similar to that described above with respect to player check-in, the dealer can press, for example, the command button 512*b* labeled '✓' to indicate completion. At that point, the dealer keypad 102 sends the additional buy-in amount to the CPU 50 via the connection 54.

Figure 6:
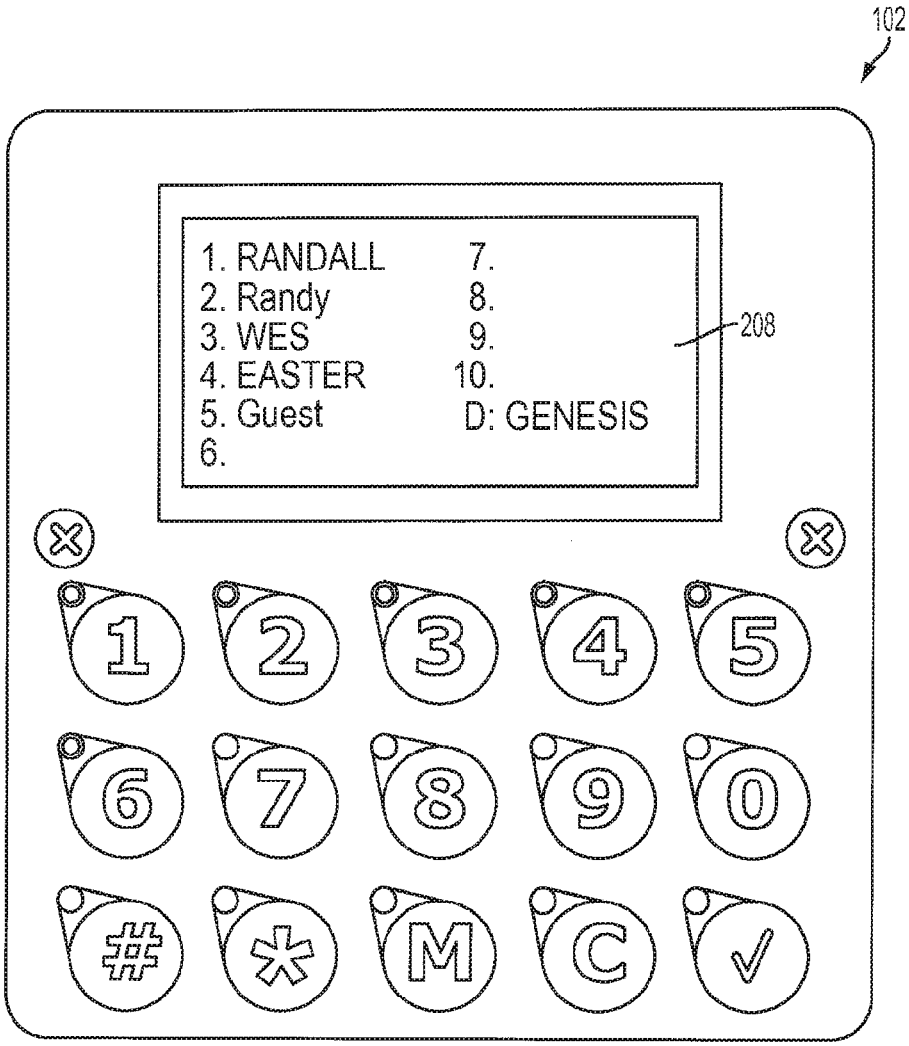
FIG. 6 provides another view of a dealer keypad.

FIG. 6 provides another view of the dealer keypad 102. For example, the display 208 illustrates a player checked-in as a guest.

Figure 7:
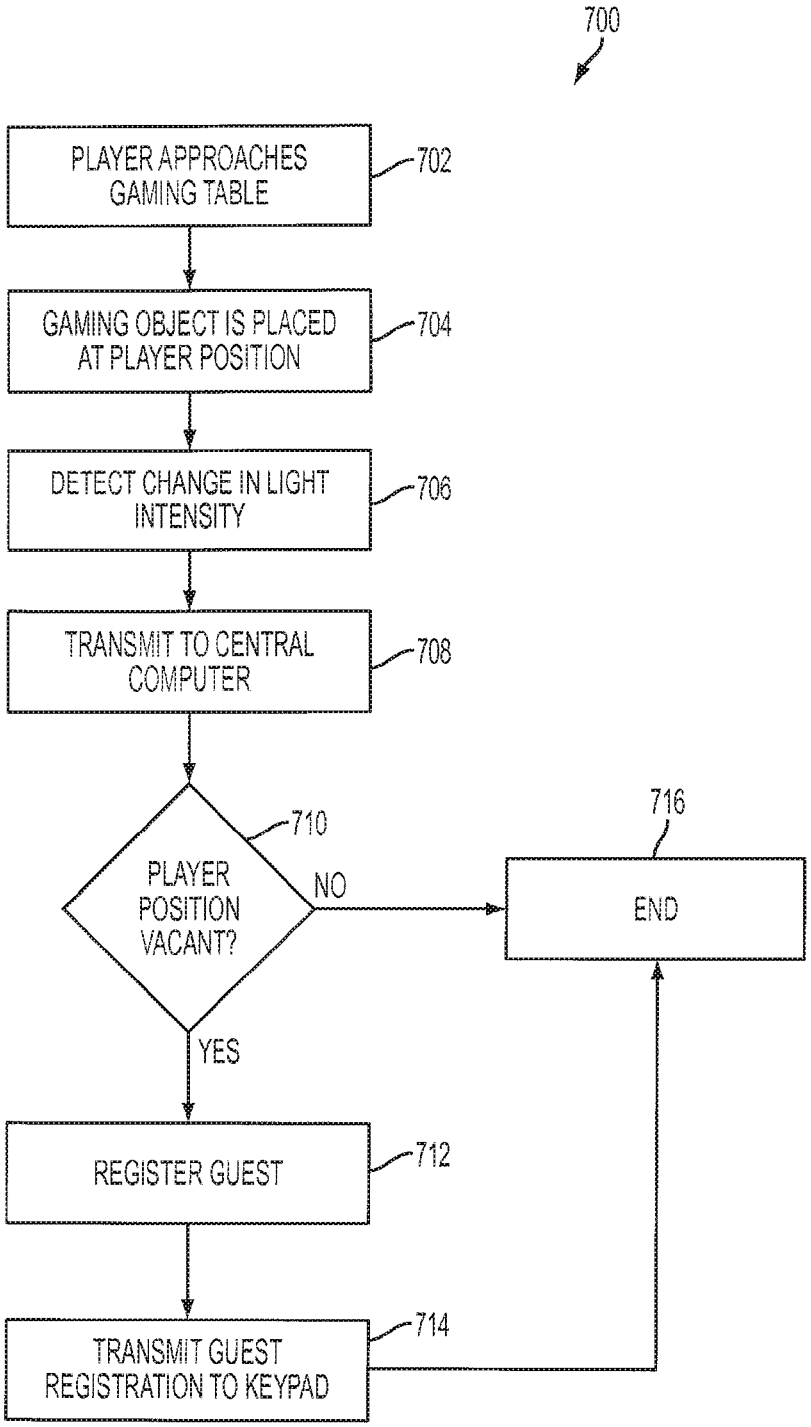
FIG. 7 illustrates a process for automatically checking-in a player as a guest.

FIG. 7 illustrates a process 700 for automatically checking-in a player as a guest. In contrast to the procedures described above with respect to FIGS. 5 and 6, the process 700 does not require data entry by a dealer. The process 700 begins at step 702. At step 702, a player approaches a player position such as, for example, one of the player positions 44 of FIG. 4. From step 702, the process 700 proceeds to step 704.

At step 704, a gaming object is placed at the player's player position. For example, the dealer may deal one or more cards to the player's position. From step 704, the process 700 proceeds to step 706. At step 706, with respect to FIG. 4, a sensor from the first group 60 that corresponds to the player's position detects a change in light intensity. From step 706, the process 700 proceeds to step 708. At step 708, the alteration in the state of the A/D converter 26 (FIG. 1) associated therewith is sensed by the processing board 46 and transmitted to the central CPU 50. From step 708, the process 700 proceeds to step 710.

At step 710, the CPU 50 determines whether the player's position is vacant. If not, the process 700 proceeds to step 716 and ends. Otherwise, the process 700 proceeds to step 712. At step 712, the CPU 50 registers a guest at the player's position at the gaming table 400. From step 712, the process 700 proceeds to step 714. At step 714, the CPU 50 transmits the guest registration to the dealer keypad 102 via the connection 54. The dealer keypad 102 then displays the name "guest" for the number associated with the player's position.

In various embodiments, the process 700 provides numerous advantages over manual check-in procedures. Via automatic guest check-in, players are more easily integrated into a gaming table and can immediately begin having activities recorded that can result in comps. Furthermore, guest check-in can occur without the dealer stopping to perform a manual task. Therefore, more hands can be dealt and more money can potentially be made at a casino. Additionally, in various embodiments, via a dealer keypad such as, for example, the dealer keypad 102 of FIG. 4, the dealer can convert a guest to that of a registered player. Once the dealer identifies the guest as a player via, for example, a card swipe, the CPU 50 can apply the activities recorded as a guest to the registered player for purposes of potential comping.

Figure 8:
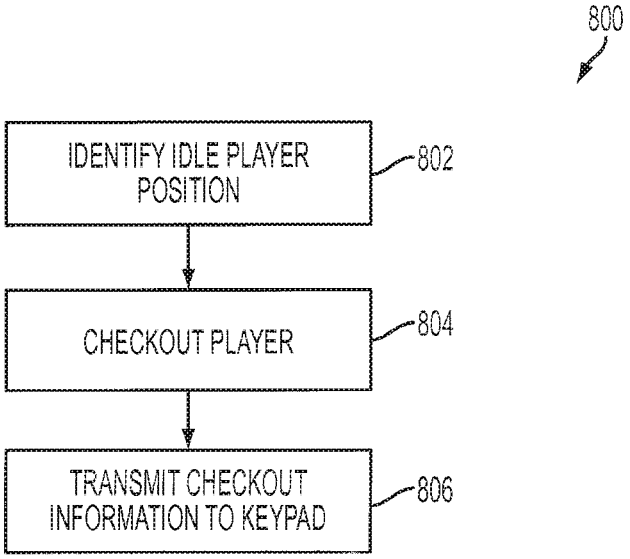
FIG. 8 illustrates a process for automatically checking-out a player from a gaming table

FIG. 8 illustrates a process 800 for automatically checking-out a player (or guest) from a gaming table. In contrast to the procedures described above with respect to FIGS. 5 and 6, the process 800 does not require data entry by a dealer. The process 800 begins at step 802. At step 802, the CPU 50 identifies an idle player position. In a typical embodiment, a player position is determined to be idle if there is a player checked-in at the player position, the player is not in "lobby" as described above, and no gaming activity has occurred for a configurable period of time. For example, for a game of blackjack, it may be determined that no gaming activity has occurred if no hands have been dealt to the player position during the configurable period of time but hands have been dealt to other player positions. In various embodiments, the configurable period of time may be customized for a given establishment such as, for example, a casino.

From step 802, the process 800 proceeds to step 804. At step 804, the CPU 50 checks-out the player from the gaming table. From step 804, the process 800 proceeds to step 806. At step 806, the CPU 50 transmits check-out information to the dealer keypad 102. At that point, the dealer keypad 102 updates the display 208 to reflect that the idle player position is now vacant. After step 806, the process 800 ends.

In various embodiments, the process 800 serves to prevent potential over-comping at gaming tables. For example, until checked-out, a player who is checked-in at a gaming table (but not in "lobby") may continue to be given credit for receiving hands at the gaming table. By checking out the player after a configurable period of time, over-comping can thereby be prevented.

Figure 9:
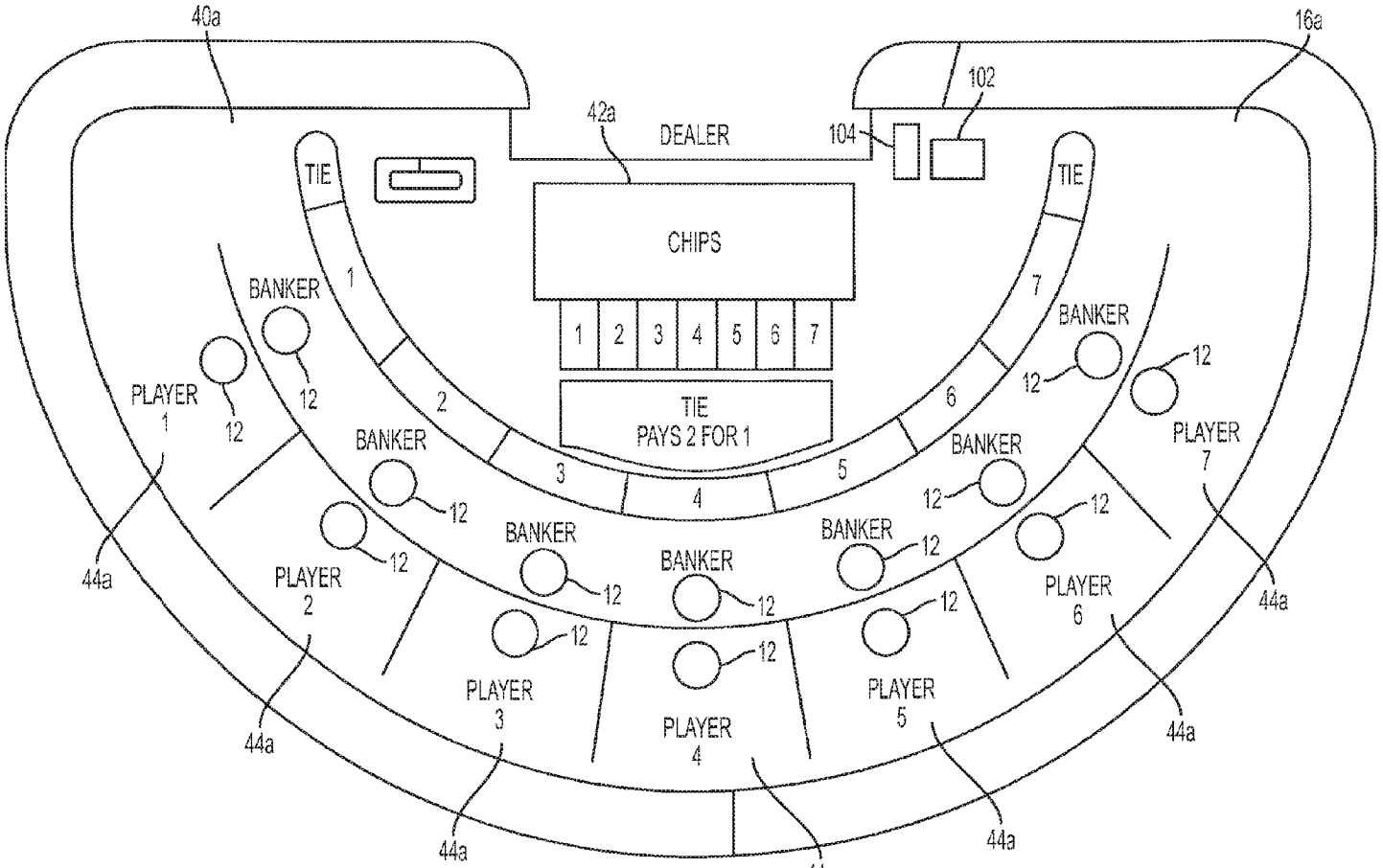
FIG. 9 illustrates an embodiment of a reporting system using card and chip detection systems.

FIG. 9 illustrates another embodiment of a reporting system using card and chip detection systems similar to those described with respect to FIGS. 1-4. A mini-baccarat tabletop 40*a* is covered with a felt layer 16*a*, as previously described with respect to the tabletop 40 and the felt layer 16 of FIGS. 2-4. A dealer's position 42*a* is positioned along one side of the tabletop 40*a*, while a plurality of player positions 44*a* are arrayed in a semi-circle along an opposite side the tabletop 40*a*. The tabletop 40*a* additionally includes the dealer keypad 102 and the card-reading apparatus 104 adjacent to the dealer position 42*a*.

Consistent with the game of baccarat, each of the player positions 44*a* provides a betting location for a "banker" bet and a betting location for a "player" bet. Two sensors 12 are positioned in proximity to each of the player positions 44*a* for purposes of accommodating and detecting each type of bet.

One of ordinary skill in the art will appreciate that baccarat games are often planned by junkets. Junkets serve to organize players that will play baccarat at one or more baccarat tables in casino. Casinos generally compensate junkets by offering a percentage commission that is calculated based on a total sum of money that is put at risk at the baccarat table. In other words, the more money that is bet (either banker or player), the more money the junket can garner.

One scam that sometimes occurs at junket-organized baccarat games involves "balanced betting." Balanced betting in baccarat refers to a practice of betting approximately equal amounts for both player and banker. Balanced betting can be practiced by an individual player or by multiple players acting in concert. When balanced betting is practiced in concert by all players at a baccarat table, very large sums of money can be bet at greatly reduced risk due to the at least partially offsetting nature of the cumulative bets. Historically, some junkets have recruited players and organized games for the purpose of artificially driving up the total money at risk and increasing the junket's commission. As a result, casinos generally prohibit balanced betting at junket-organized baccarat games.

With reference to FIG. 9, the sensors 12 operate as described with respect to FIGS. 1-4. Thus, although not specifically shown in FIG. 9, the sensors communicate with the processing board 46 and the central CPU 50 as described with respect to FIGS. 3 and 4. In a typical embodiment, the sensors 12 depicted in FIG. 9 are used to determine when a banker bet or a player bet has been placed at one of the player positions 44.

If one or more gaming objects (e.g., chips) are placed over any of the sensors 12 of FIG. 9, the alteration in the state of the A/D converter 26 (FIG. 1) associated therewith will be sensed by the processing board 46 and transmitted to the central CPU 50 and stored. In that way, the central CPU 50 stores each bet and thus can determine a total number of "banker" bets and a total number of "player" bets for a hand. Therefore, the CPU 50 is operable to determine whether a potential balanced-betting situation is present. In a typical embodiment, the CPU 50 determines a potential balanced-betting situation to be present when a total number of "player" bets equals a total number of "banker" bets. If that occurs, in a typical embodiment, the CPU 50 may cause a silent alarm to be sounded or send a notification to the dealer keypad 120. In that way, closer scrutiny may be given to the betting and gaming security may be improved.

Figure 10:
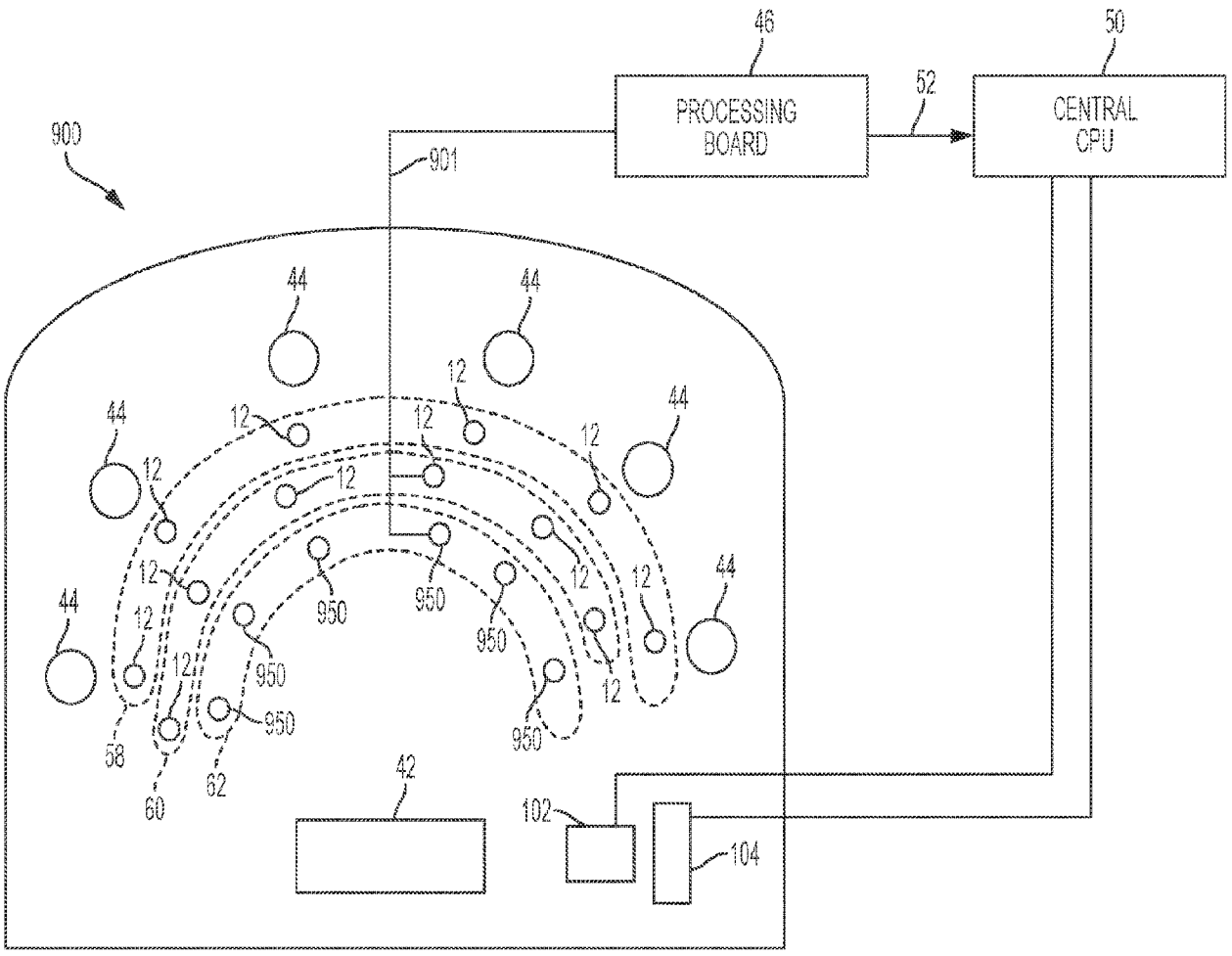
FIG. 10 is a schematic view of a data transmission portion of the system utilizing the bet spot indicator.
Figure 11:
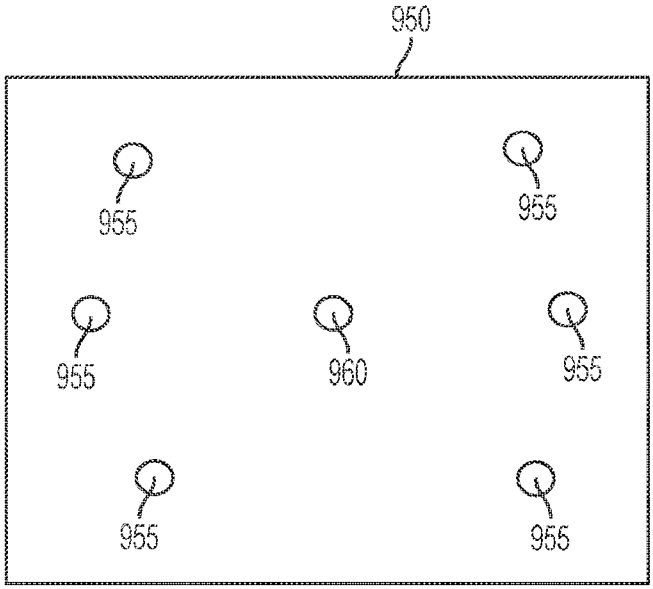
FIG. 11 illustrates a bet spot indicator assembly having a light sensor and a plurality of light emitting diodes (LEDs) associated therewith.

FIG. 10 illustrates an embodiment of a bet spot indicator utilizing a bet spot indicator having a light sensor and a plurality of light emitting diodes, which are illustrated and described with respect to FIG. 11. In particular, a gaming table 900 is illustrated. For purposes of illustration, the sensors 12 illustrated with respect to FIG. 3 and described above are grouped together in FIG. 10 as a first group 60. A second group 58 of the sensors 12 is disposed above the first group 60 and adjacent to the player positions 44. A bet spot indicator assembly 950 illustrated with respect to FIG. 11 and described below are grouped together in FIG. 10 as third group 62 of bet spot indicators 950. For purposes of illustration, FIG. 10 shows the third group 62 as a group of progressive bet spots. However, one of ordinary skill in the art will appreciate that, in addition to a progressive bet spot, bet spot indicator assembly 950 may be used with any bet spot on the table layout on a gaming table, such as, for example, a blackjack bet, a pai gow bet, and a proposition bet to name a few non-limiting examples. A dealer keypad 102 and a card-reading apparatus 104 are positioned on the tabletop 900 in proximity to the dealer's position 42.

The dealer keypad 102 and the card-reading apparatus 104 are electronically coupled to the central processing unit (CPU) 50 through a connection 54 and a connection 56, respectively. In various embodiments, the connections 54 and 56 include a transceiver assigned to the table that receives and transmits data to the CPU 50. In the case of the connection 54, the transceiver may relay data intended for the dealer keypad 102 from the CPU 50 to the dealer keypad 102. The transceiver may be, for example, a computing device that communicates via wired Ethernet and/or wirelessly. In various embodiments, the connections 48, 54, and 56 may share a single transceiver.

In a typical embodiment, the bet spot indicator 950 in the third group 62 may be used to indicate whether a bet has been placed in the bet spot. If one or more gaming objects (e.g., chips) are placed over any of the bet spot indicator 950 in the third group 62, the alteration in the state of the A/D converter (not shown) associated therewith will be sensed by the processing board 46 and transmitted to the central CPU 50 for processing. For example, the CPU 50 may send an instruction to bet spot indicator assemblies 950 to illuminate the plurality of LEDs associated with the light sensor on the assembly 950 in response to a change in the light intensity so as to indicate a bet placed in the associated bet spot. In that way, the dealer and player may receive immediate visual feedback that a bet, such as a progressive or proposition bet, is placed in the bet spot.

Each of the bet spot indicator assemblies 950 is coupled electronically with a processing board 46 through a connection 901. The processing board 46 is electronically coupled to a central processing unit (CPU) 50, possibly wirelessly, through a connection 52. In various embodiments, the connection 52 includes a transceiver assigned to the table that receives data from the processing board 46 and transmits the data to the CPU 50. The transceiver may be, for example, a computing device that communicates via wired Ethernet or wirelessly. In a typical embodiment, the CPU 50 is representative of a management system such as, for example, a casino management system, and may be representative of one or more physical or virtual server computers. In a typical embodiment, the CPU 50 stores for and facilitates management of a plurality of gaming tables.

Processing board 46 may be operable to detect changes in light intensity at the light sensors and illuminate the plurality of LEDs of the bet spot indicator assembly 950. In another embodiment, CPU 50 instructs processing board 46 to illuminate the LEDs associated with the light sensor detecting the change in light intensity. In another embodiment, the CPU 50 is operable to perform at least one operation based on a status of the light sensors transmitted to the CPU by the processing board 46. One example of an operation is illuminating the LEDs associated with the light sensor that detects a change in light intensity.

Preferably, each of the bet spot indicator assemblies 950 is monitored continuously, so that any alteration in the state of the A/D converter associated with any bet spot indicator will be sensed by the processing board 46 and transmitted to the CPU for processing.

Figure 12:
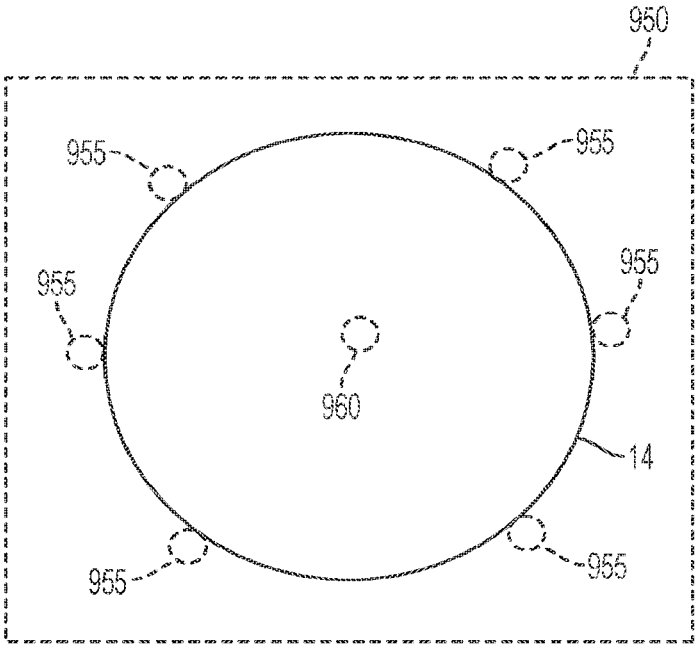
FIG. 12 illustrates the bet spot indicator assembly of FIG. 11 mounted on a gaming table under a bet spot on a gaming table layout.

FIG. 11 illustrates one embodiment of a bet spot indicator assembly 950. In the illustrated embodiment, bet spot indicator assembly 950 generally comprises a cadmium sulphide sensor 960 whose resistance changes in response to light, as powered from a cable through a conductor (not shown). The light sensor 960 pulls against a resistance to create a changing voltage point, in a manner known in the art. This changing voltage point is measured using an Analog to Digital (A/D) converter (not shown) through a conductor and calibrated continuously to detect changes in light through fabrics and changing lighting conditions. The bet spot indicator assembly 950 also contains a plurality of light-emitting diodes 955, which serves as a bet spot indicator and is optically isolated from the light sensor. As shown in FIG. 12, the bet spot indicator assembly 950 is preferably mounted to a gaming table beneath a bet spot 14 associated with a gaming table layout.

Figure 13:
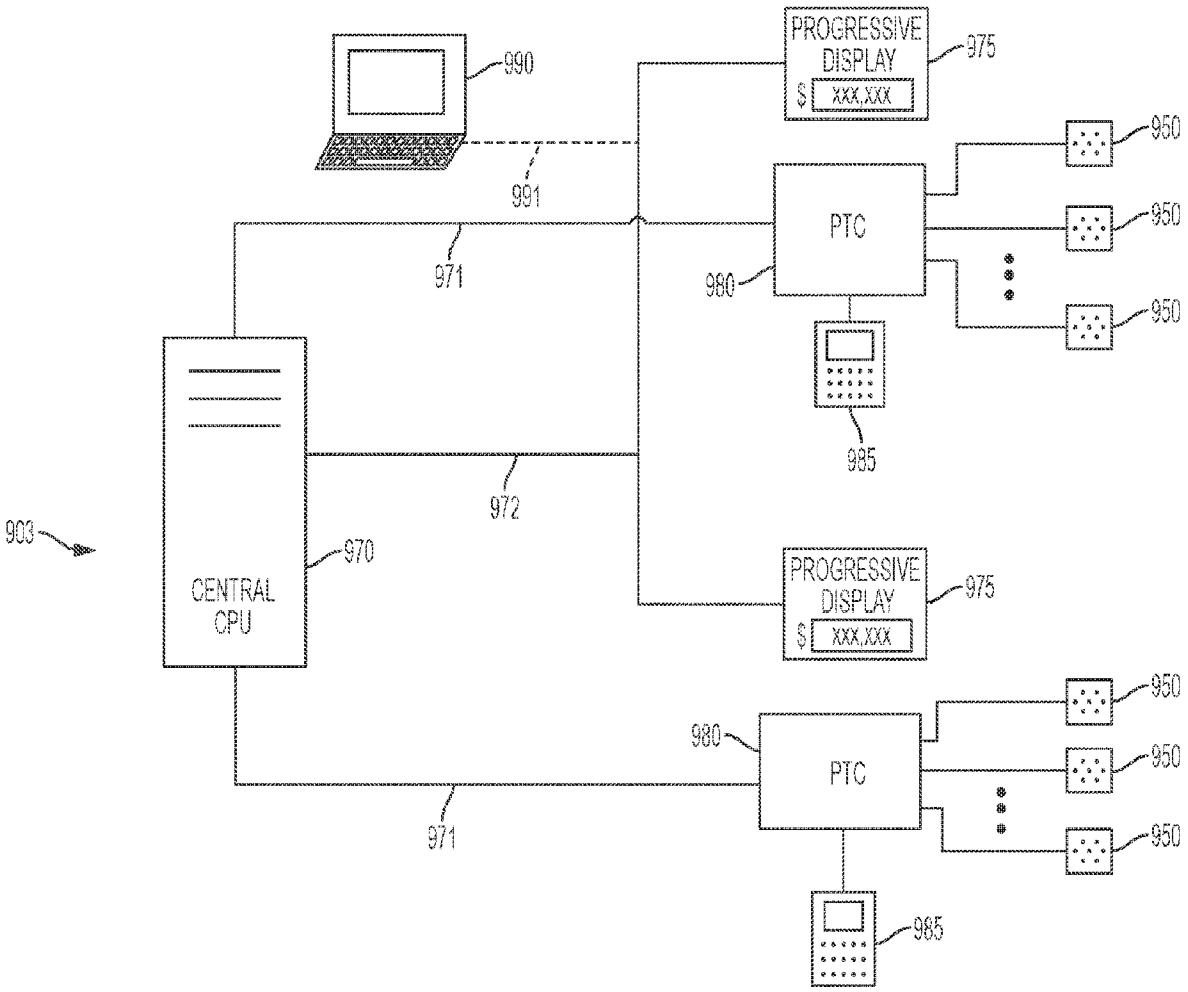
FIG. 13 illustrates a schematic diagram of progressive system utilizing a bet spot indicator on a progressive bet spot.

FIG. 13 shows a typical progressive system 903. Each gaming table (not shown) in progressive system 903 is constructed to have a control unit 908, a plurality of bet spot indicator assemblies 950 associated with each progressive bet spot on the table, a dealer control unit 985 and a progressive display 975. As shown, the PTC unit 980 (e.g., electronic system) of each gaming table is coupled to a central CPU 970 through a connection 970, which may be hard wired or wireless. The operation of the progressive jackpot may be administered by the central CPU 970, or alternatively by a separate process running on computer 990 coupled to the progressive displays 975 over connection 991, which may be hard wired or wireless. If CPU 970 administers the progressive jackpot of the system, the progressive jackpot value is stored and updated by CPU 970.

Dealer control unit 985 may be configured to receive information related to the bets in the progressive area at each player position at the gaming table and transmit the information to the computer 970. Control unit 985 may then receive confirmation from the computer 970 that the progressive jackpot has been incremented by a predetermined amount based upon the number of player positions placing a progressive bet in the progressive bet spots and update display 975 responsive to the received confirmation.

CPU 970 may be configured to receive information related to a change in light intensity at a light sensor associated with bet spot indicator assembly 950, determine whether a bet spot is covered, and, responsive to a determination that the bet spot is covered, transmit an instruction to the PTC unit 980 to illuminate the plurality of LEDs associated with the light sensor having a change in the light intensity to indicate a bet placed in the progressive bet spot. CPU 970 may also be configured to transmit a notification to increment the progressive jackpot value associated with the progressive system 903.

Continuing with system 903, each gaming table comprises a dealer control unit 985 communicatively coupled to the bet spot indicator assembly 950. In operation, the dealer control unit 985 is configured to transmit notifications to automatically lock and store information regarding a progressive bet placed in the progressive bet spot when the dealer unit is activated. Progressive display 975, such as an LCD display, is positioned proximate the gaming table. In operation, the progressive display 975 displays a progressive jackpot value. In one embodiment, the progressive jackpot value is automatically updated by a predetermined amount when a gaming chip is detected in the progressive bet spot by the bet spot indicator assembly 950 when the dealer control unit 950 is activated to lock the progressive bets.

In operation, a light sensor is positioned proximate a player location on the table top designated for the placement of a progressive bet associated with each player position. If a bet is detected, the plurality of LEDs associated with the at least one light sensor illuminate to indicate a bet has been placed in the location designated for the placement of a progressive bet. Typically, the LEDs are arranged beneath the gaming table layout to surround the location designated for the placement of progressive bets and the LEDs illuminate in a unique pattern.

Alternatively, a light sensor may be positioned proximate a location on the table top designated for the placement of a proposition bet associated with each player position. In such a case, the plurality of LEDs associated with the at least one light sensor illuminate to indicate a bet placed in the location designated for the placement of a proposition bet.

Figure 14:
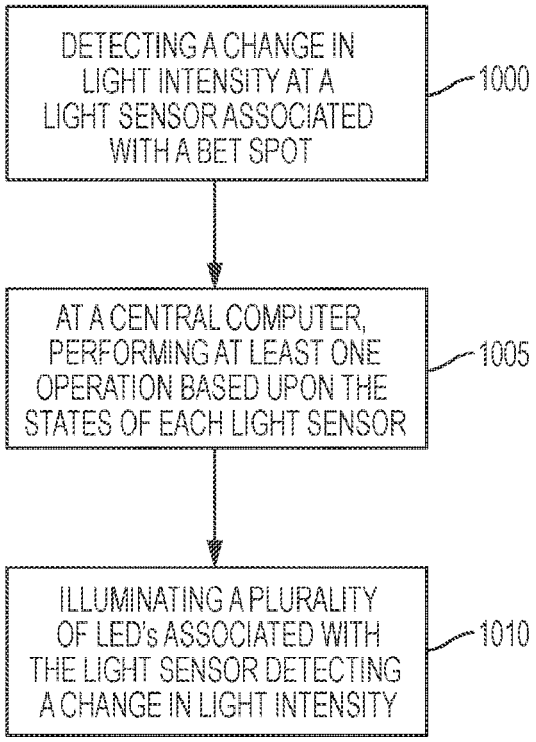
FIG. 14 illustrates a process for operating a bet spot indicator.

FIG. 14 illustrates one embodiment of a method of visually indicating the presence of a bet in a bet spot. At operation 1000, a change in light intensity is detected via a light sensor on bet spot indicator assembly 950 positioned beneath a gaming table layout on the gaming table in proximity to a player position at a gaming table. The change in light intensity is detected through the layout. Either the CPU or the PTC unit processes the change in light intensity. In response, a notification is transmitted to the bet spot indicator assembly 950 to illuminate a plurality of light emitting diodes (LEDs) positioned beneath the gaming table layout on the gaming table and associated with the light sensor in response to detecting a change in the light intensity at the light sensor.

Figure 15:
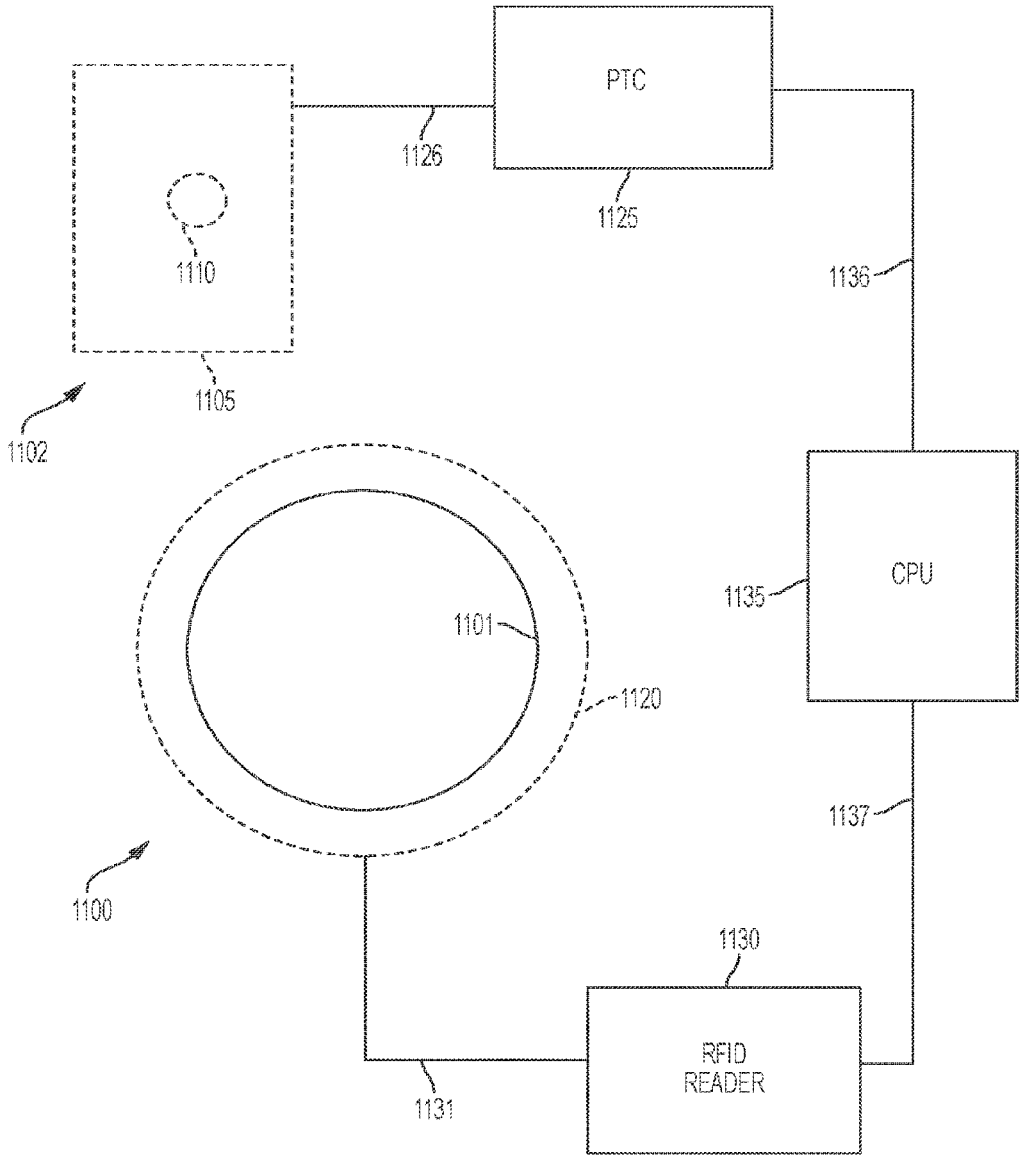
FIG. 15 is a schematic diagram of a system for both visually indicating the presence of a bet in a bet spot and determining the amount of the bet.

FIG. 15 shows a typical system 1100 for determining the value of the gaming chip(s) in the bet spot 1101 once a card is dealt to a player. The illustrated system 1100 generally comprises a sensor assembly 1102 configured to determine if a playing card has been dealt to the player occupying the player position associated with bet spot 1101. Sensor assembly 1102 generally comprises a light sensor board 1105 having a cadmium sulphide sensor 1110 whose resistance changes in response to light. Sensor assembly 1102 is communicatively coupled to a control device 1125, possibly wirelessly, through a connection 1126. In addition, the illustrated system 1100 comprises an RFID antenna 1120 surrounding bet spot 1101 and an RFID reader 1125 configured to communicate with the antenna 1120 to determine the amount of the bet in bet spot 1101 using RFID enabled gaming chips (not shown). RFID antenna 1120 is communicatively coupled to an RFID reader 1130 through a connection 1131. In the illustrated embodiment, PTC 1125 and RFID reader 1130 are communicatively coupled to a CPU 1135 over connection 1136 and connection 1137 respectively. PTC 1125 and RFID reader 1130 may exchange information and instructions with CPU 1135, such as a notification of a change in light intensity at sensor assembly 1102 or a determination of the amount associated with the gaming chips placed in bet spot 1101.

In operation, the system is able to record the amount of the player's bet found in bet spot 1101 once the sensor assembly 1102 detects the presence of a playing card (indicating the player has been dealt a hand), which triggers the combination of the antenna 1120 and RFID reader determine the amount of the bet in bet spot 1102. More specifically, the playing card is dealt to a player near the player's bet spot 1101, and therefore covers the cadmium sulphide sensor associated with sensor assembly 1102. The combination of the processing board 1125 and CPU 1135 detect the presence of the card, and thereafter the CPU 1135 triggers the RFID reader 1130 to read the RFID enabled gaming chips found in bet spot 1101. Such an operation allows a casino to track a player's bet amounts more accurately.

In another embodiment, the value of the progressive jackpot in progressive system 903 may be increased by a predetermined percentage of the value of the RFID enabled gaming chip(s) read in bet spot 1101.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

We claim:

1. A gaming table comprising:

a tabletop having a top surface covered by a gaming table layout;

a plurality of bet spots positioned on the top surface;

a light sensor associated with each bet spot and positioned beneath the gaming table layout to detect light intensity through the gaming table layout; and a plurality of light emitting diodes (LEDs) positioned in proximity to and associated with each light sensor, the plurality of LEDs positioned beneath the gaming table layout to illuminate through the gaming table layout, each LED of the plurality of LEDs configured to illuminate in response to a change in the light intensity detected by the light sensor associated with the LED.

2. The gaming table of claim 1, further comprising an electronic system communicably coupled to the light sensors, the electronic system operable to detect changes in light intensity at the light sensors and illuminate the plurality of LEDs.

3. The gaming table of claim 2, further comprising a computer communicably coupled to the electronic system, wherein the computer is operable to perform at least one operation based on a status of the light sensors.

4. The gaming table of claim 3, wherein the status comprises detecting a change in light intensity at a light sensor, and wherein the operation comprises illuminating one or more LEDs associated with the light sensor.

5. The gaming table of claim 1, further comprising a means for determining a value of a gaming chip in at least one bet spot.

6. The gaming table of claim 5, wherein the means for determining the value of the gaming chip comprises an antenna associated with the at least one bet spot and an RFID reader coupled to the antenna.

7. The gaming table of claim 5, wherein the means for determining the value of the gaming chip comprises a camera.

8. The gaming table of claim 1, wherein the bet spot is a progressive bet spot.

9. The gaming table of claim 8, further comprising, a dealer unit communicatively coupled to the light sensors, the dealer unit configured to transmit notifications to automatically lock and store information regarding a progressive bet placed in the progressive bet spot when the dealer unit is activated; and a progressive display positioned proximate the gaming table, the progressive display operable to display a progressive jackpot value.

10. The gaming table of claim 9, wherein the progressive jackpot value is automatically updated by a predetermined amount when a gaming chip is detected in the progressive bet spot when the dealer unit is activated to lock progressive bets.

11. The gaming table of claim 10, further comprising a means for determining a value of the gaming chip in the progressive bet spot, and wherein the progressive jackpot value is increased by a predetermined percentage of the value of the gaming chip.

12. The gaming table of claim 11, wherein the means for determining the value of the gaming chip in the bet spot is an antenna associated with the progressive bet spot and an RFID reader coupled to the antenna.

13. The gaming table of claim 11, wherein the means for determining the value of the gaming chip in the progressive bet spot is a camera.

14. The gaming table of claim 9, further comprising an electronic system communicably coupled to the dealer unit and the light sensors, the electronic system operable to detect changes in light intensity at the light sensors and illuminate the plurality of LEDs.

15. The gaming table of claim 14, wherein the electronic system is further operable to transmit a notification to update the progressive jackpot value.

16. The gaming table of claim 14, further comprising a computer communicably coupled to the electronic system, wherein the computer is operable to perform at least one operation based on a status of the light sensors.

17. The gaming table of claim 16, wherein the status comprises detecting a change in light intensity at a light sensor, and wherein the operation comprises illuminating one or more LEDs associated with the light sensor detecting the change in light intensity, updating the progressive jackpot value by a predetermined amount and storing the progressive jackpot value in memory.

18. The gaming table of claim 16, wherein the operation further comprises displaying the progressive jackpot value on the progressive display.

19. A system comprising:

a plurality of gaming tables, each gaming table comprising, a tabletop having a top surface covered by a gaming table layout, a plurality of progressive bet spots positioned on the top surface;

at least one light sensor associated with each progressive bet spot and positioned beneath the gaming table layout to detect light intensity through the gaming table layout, a plurality of light emitting diodes (LEDs) positioned in proximity to and associated with each light sensor of the at least one light sensor, the plurality of LEDs positioned beneath the gaming table layout to illuminate through the gaming table layout, each LED of the plurality of LEDs configured to illuminate when a gaming chip is detected in the progressive bet spot causing a change in the light intensity detected by the light sensor associated with the LED, a dealer unit communicatively coupled to each the at least one light sensor, the dealer unit configured to transmit notifications to automatically lock and store information regarding a progressive bet placed in each progressive bet spot of the plurality of progressive bet spots when the dealer unit is activated, a progressive display positioned proximate the gaming table, the progressive display operable to display a progressive jackpot value, and an electronic system communicably coupled to the dealer unit, the at least one light sensor and the plurality of LEDs, the electronic system operable to detect changes in light intensity at the at least one light sensor and thereafter illuminate the plurality of LEDs associated with the light sensor having a change in the light intensity; and a central computer communicably coupled to each gaming table, wherein the central computer is operable to perform at least one operation based on a status of the at least one light sensor.

20. A method comprising:

detecting a change in light intensity in proximity to a position at a gaming table;

wherein the detection is performed via at least one light sensor positioned beneath a gaming table layout on the gaming table, the detecting comprising detecting the change in light intensity through the gaming table layout;

at a central computer, performing at least one operation based on a status of the at least one light sensor; and illuminating a plurality of light emitting diodes (LEDs) in response to detecting a change in the light intensity at the light sensor, wherein the illumination is performed via a plurality of LEDs positioned beneath the gaming table layout on the gaming table and associated with the light sensor, the illuminating comprising activating the LEDs associated with the light sensor that detected the change in light intensity.

* * * * *